US010316603B2

(12) United States Patent
Rytlewski

(10) Patent No.: US 10,316,603 B2
(45) Date of Patent: Jun. 11, 2019

(54) FAILSAFE VALVE SYSTEM

(71) Applicant: Schlumberger Technology Corporation, Sugar Land, TX (US)

(72) Inventor: Gary L. Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/189,887

(22) Filed: Jun. 22, 2016

(65) Prior Publication Data

US 2017/0370170 A1 Dec. 28, 2017

(51) Int. Cl.

| | |
|---|---|
| ***E21B 29/08*** | (2006.01) |
| ***E21B 17/20*** | (2006.01) |
| ***E21B 33/064*** | (2006.01) |
| ***E21B 34/04*** | (2006.01) |
| ***E21B 34/10*** | (2006.01) |
| *E21B 34/00* | (2006.01) |

(52) U.S. Cl.

CPC ..... *E21B 29/08* (2013.01); *E21B 17/20* (2013.01); *E21B 33/064* (2013.01); *E21B 34/045* (2013.01); *E21B 34/102* (2013.01); *E21B 2034/002* (2013.01); *E21B 2034/005* (2013.01)

(58) Field of Classification Search

CPC ..... E21B 29/08; E21B 17/20; E21B 33/064; E21B 34/045; E21B 34/102; E21B 2034/002; E21B 2034/005

See application file for complete search history.

(56) References Cited

U.S. PATENT DOCUMENTS 3,921,500 A * 11/1975 Silcox ..... E21B 33/0355 166/338
4,494,609 A * 1/1985 Schwendemann ..... E21B 17/06 166/322

(Continued)

FOREIGN PATENT DOCUMENTS

WO 2013032987 A1 3/2013
WO 2016001630 A1 1/2016

OTHER PUBLICATIONS

Extended European Search Report issued in European Patent Application No. 17177534.9 dated Jan. 29, 2018; 8 pages.

*Primary Examiner* — Matthew R Buck
*Assistant Examiner* — Douglas S Wood
(74) *Attorney, Agent, or Firm* — Brandon S. Clark

(57) ABSTRACT

A technique facilitates failsafe closure of a valve used in, for example, a subsea test tree. The technique utilizes a valve combined with a cutter oriented to sever well equipment passing through an interior passage of the valve. The valve is operatively coupled with an actuation system having an actuator piston which controls cutting and valve closure. The failsafe valve and the cutter are shifted to an open position by applying pressure in a control fluid chamber to shift the actuator piston. However, the actuator piston, and thus the valve and cutter, are biased toward a closed position via pressure applied in a pressure chamber and a gas precharge chamber. The combined pressure ensures adequate force for shearing of the well equipment and closure of the valve when hydraulic control pressure is lost. In some applications, additional closing force may be selectively provided to the actuator piston.

19 Claims, 4 Drawing Sheets

(56) References Cited

U.S. PATENT DOCUMENTS

| | | | | |
|---|---|---|---|---|
| 4,546,953 | A | 10/1985 | Vinciguerra et al. | |
| 7,624,792 | B2 * | 12/2009 | Wright | E21B 33/06 137/68.11 |
| 7,628,207 | B2 | 12/2009 | Leonardi et al. | |
| 7,984,764 | B2 | 7/2011 | Leonardi et al. | |
| 8,002,041 | B2 | 8/2011 | Leonardi et al. | |
| 2013/0062069 | A1 | 3/2013 | Du | |

* cited by examiner

FAILSAFE VALVE SYSTEM

BACKGROUND

In a variety of subsea well applications, a subsea test tree is deployed into subsurface equipment to enable subsea well control during completion operations, flow testing operations, intervention operations, or other subsea well operations performed from a surface facility, such as a floating vessel. For example, the subsea test tree may be used within a subsea blowout preventer to control fluid flow. Depending on the subsea operation, various types of well equipment, e.g. coiled tubing or wireline, may be deployed through the subsea test tree via an interior passageway. The subsea test tree also comprises several valves, including valves which fail to a closed position to secure the wellbore if hydraulic control pressure is lost. However, if the hydraulic control pressure is lost when the well equipment is disposed in the interior passageway, difficulties can arise with respect to shearing equipment, e.g. coiled tubing, to enable closure of the failsafe valve. Some failsafe valves are in the form of ball valves which close under the force of a mechanical spring. However, the mechanical spring tends to provide insufficient force for shearing coiled tubing and other types of equipment.

SUMMARY

In general, a system and methodology facilitate failsafe closure of a valve used in, for example, a subsea test tree. The system and methodology enable sufficient application of force to combine the failsafe valve with a cutter able to cut through coiled tubing and other well equipment. In this embodiment, a valve is combined with a cutter oriented to sever well equipment passing through an interior passage of the valve. The valve is operatively coupled with an actuation system having an actuator piston which controls cutting and valve closure. The failsafe valve and the cutter are shifted to an open position by applying pressure in a control fluid chamber to shift the actuator piston. However, the actuator piston, and thus the valve and cutter, are biased toward a closed position via pressure applied in a pressure chamber and a gas precharge chamber. The combined pressure ensures adequate force for shearing of the well equipment and closure of the valve when hydraulic control pressure is lost. In some applications, additional closing force may be selectively provided to the actuator piston.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
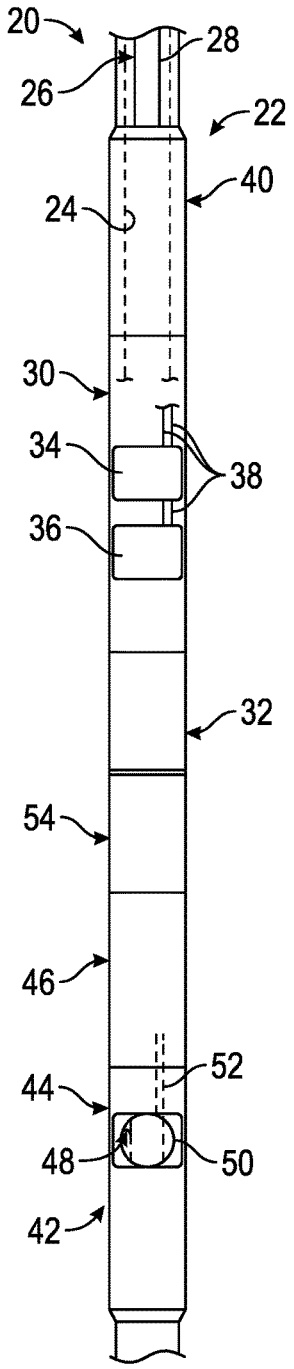
FIG. 1 is a schematic illustration of an example of a subsea test tree having a failsafe valve coupled with an actuation system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate failsafe closure of a valve used in, for example, a subsea test tree. The subsea test tree may be deployed into subsea equipment, such as a blowout preventer, wellhead, and/or Christmas tree. Depending on the application, the subsea test tree may comprise a variety of hydraulically controllable valves able to facilitate various completion operations, flow testing operations, intervention operations, or other well related operations. Additionally, the subsea test tree comprises at least one failsafe valve which fails to a closed position to prevent unwanted flow of well fluids through the subsea test tree in the event hydraulic control is lost. In some applications, a plurality of failsafe valves may be utilized, for example, below a latch connector.

As described in greater detail below, at least one of the failsafe valves is coupled to an actuator system which substantially increases the force applied for valve closure. This type of system provides the failsafe valve with substantial cutting capability so that various types of well equipment, e.g. coiled tubing, wireline, slick line, may be sheared during failsafe closure of the valve. According to an embodiment, the system and methodology enable sufficient application of force to combine the failsafe valve with a cutter able to cut through the well equipment extending along an interior passage of the subsea test tree.

In this embodiment, the valve is operatively coupled with an actuation system having an actuator piston which can be actuated with sufficient power to ensure both cutting and valve closure. The failsafe valve and the cutter may be shifted to an open position by applying pressure in a control fluid chamber to shift the actuator piston. However, the actuator piston, and thus the valve and cutter, are biased toward a closed position. For example, the valve and cutter may be biased to the closed position via pressure applied cumulatively in a pressure chamber and a gas precharge chamber. The combined closure pressures ensure adequate force for shearing of the well equipment and closure of the valve when hydraulic control pressure is lost. In some applications, additional closing force may be selectively provided to the actuator piston.

The valve and cutter combination may be constructed with a variety of valve types and also a variety of cutter types. In some embodiments, the valve and the cutter may be separate units which are both operable by the actuator piston. However, the cutter also may be combined with the valve. For example, the cutter may be in the form of a cutter edge mounted to, or formed along, an edge of a ball valve or a spherical gate cutter or gate valve.

Referring generally to FIG. 1, an example of a well system 20 is illustrated. In this embodiment, the well system 20 comprises a subsea test tree 22 which may be deployed into suitable subsea equipment, such as a blowout preventer, wellhead, and/or Christmas tree. The subsea test tree 22 comprises an interior passage 24 through which well equipment 26, e.g. coiled tubing 28, may be deployed. Depending on the parameters of a given application, the subsea test tree 22 may comprise a variety of components and the embodiment illustrated in FIG. 1 is provided for purposes of explanation. Additional and/or other components may be combined into the subsea test tree 22.

In the embodiment illustrated, subsea test tree 22 comprises an upper valve section 30 disposed above a latch connector 32. By way of example, the upper valve section 30 may comprise a plurality of valves, such as a bleed off valve 34 and a retainer valve 36 which may be hydraulically controlled via hydraulic control lines 38. In some applications, a lubricator valve 40 also may be coupled with the upper valve section 30. It should be noted that the number, arrangement, and type of valves disposed in upper valve section 30 may vary depending on the parameters of a given subsea operation.

Below latch connector 32, the subsea test tree 22 may comprise a lower valve section 42 having at least one failsafe valve 44 operatively coupled with an actuation system 46. The actuation system 46 automatically shifts the failsafe valve 44 to a closed position to block fluid flow along interior passage 24 in the event hydraulic control over the subsea test tree 22 is lost. For example, if the subsea test tree 22 is separated at latch connector 32, the actuation system 46 is able to automatically close the failsafe valve 44 and prevent unwanted flow through interior passage 24.

In this example, the failsafe valve 44 is combined with a cutter 48 which is oriented to cut through the coiled tubing 28 or other well equipment 26 which may be disposed along interior passage 24 and through the failsafe valve 44. By way of example, the cutter 48 may comprise a cutting edge formed of a hardened steel material, composite material, or other suitable material. The cutting edge of cutter 48 is able to shear through well equipment 26 when failsafe valve 44 is closed with sufficient force.

The failsafe valve 44 may be constructed in a variety of configurations. For example, the failsafe valve 44 may be in the form of a ball valve 49 or spherical gate valve. The failsafe valve 44 may be operatively coupled with actuation system 46 via an actuation link 50. The actuation link 50 may be a mechanical link, e.g. an actuator arm, or a fluid link, e.g. a flow passage, able to forcibly drive valve 44 to the closed position when directed by actuation system 46. In this example, the actuation system 46 also is coupled with a subsea control system 52, e.g. a subsea electrohydraulic control system, which provides the pressure for operation of actuation system 46 with the desired cutting and closing capability. By way of example, the subsea control system 52 may be configured to enable selective pressurization of a control line to at least an annulus pressure as described in greater detail below. In some applications, the subsea control system 52 comprises a pressure compensated chamber and/or a stored pressure volume pressurized to a desired pressure level, e.g. a pressure level in the range from 5000 psi to 10,000 psi.

It should be noted that other components and features also may be located below latch connector 32. In some embodiments, an additional valve 54, e.g. a flapper valve, may be positioned below latch connector 32, e.g. between actuation system 46 and latch connector 32. The flapper valve 54 also may be in the form of a failsafe closure valve.

Figure 2:
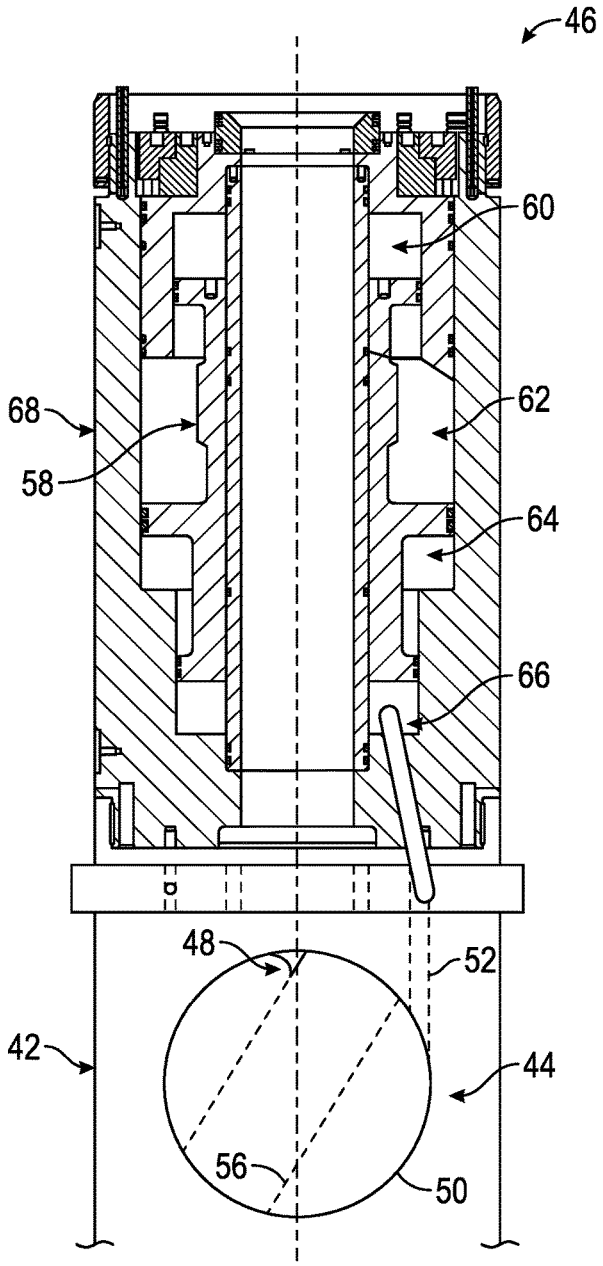
FIG. 2 is a cross-sectional view of an example of an actuation system coupled with a failsafe valve, according to an embodiment of the disclosure.

Referring generally to FIG. 2, an embodiment of actuation system 46 is illustrated in cross-section as attached to failsafe valve 44. In this example, the failsafe valve 44 is in the form of ball valve 49 although the valve 44 may be a spherical gate valve or other suitable valve. Additionally, the valve 44 comprises an interior passage 56 which effectively is a continuation of the interior passage 24, passing through the subsea test tree 22, when passage 56 is aligned with passage 24. The valve 44 also is combined with cutter 48 which may be in the form of a cutting edge positioned along an edge of the ball valve 49 adjacent interior passage 56.

In this embodiment, the actuation system 46 comprises an actuator piston 58 coupled to the failsafe cutter valve 44 via hydraulic or mechanical link 50. The actuator piston 58 is in fluid communication with a pressure chamber 60, a gas precharge chamber 62, a low-pressure chamber 64 (e.g. an atmospheric pressure chamber or low-pressure gas charged chamber), and a control fluid chamber 66. The actuator piston 58 is slidably mounted within an actuator system housing 68 and is configured to form the various chambers 60, 62, 64, 66 along the interior of housing 68.

In this example, the control fluid chamber 66 is pressurized to move the actuator piston 58 and thus the cutter valve 44 to an open position. In other words, pressurizing hydraulic fluid in control fluid chamber 66 with sufficient pressure causes the actuator piston 58 to move upwardly with respect to housing 68 in the example illustrated in FIG. 2. However, the pressure chamber 60 and the gas precharge chamber 62 cooperate to bias the actuator piston 58 and the cutter valve 44 in an opposite direction toward a closed position. The pressure chamber 60 may be coupled with subsea control system 52 which supplies the pressure chamber 60 with fluid at an annulus pressure or a higher pressure.

Actuator piston 58, pressure chamber 60, and gas precharge chamber 62 are configured such that the pressures in pressure chamber 60 and gas precharge chamber 62 are cumulative. The combined pressures of pressure chamber 60 and gas precharge chamber 62 can be used to shift actuator piston 58 and thus failsafe valve 44 with sufficient force to cut through well equipment 26 positioned along interior passage 24 and to thus close valve 44. When failsafe valve 44 is in the closed position, fluids, e.g. well fluids, are blocked from flowing upwardly along interior passage 24.

Figure 3:
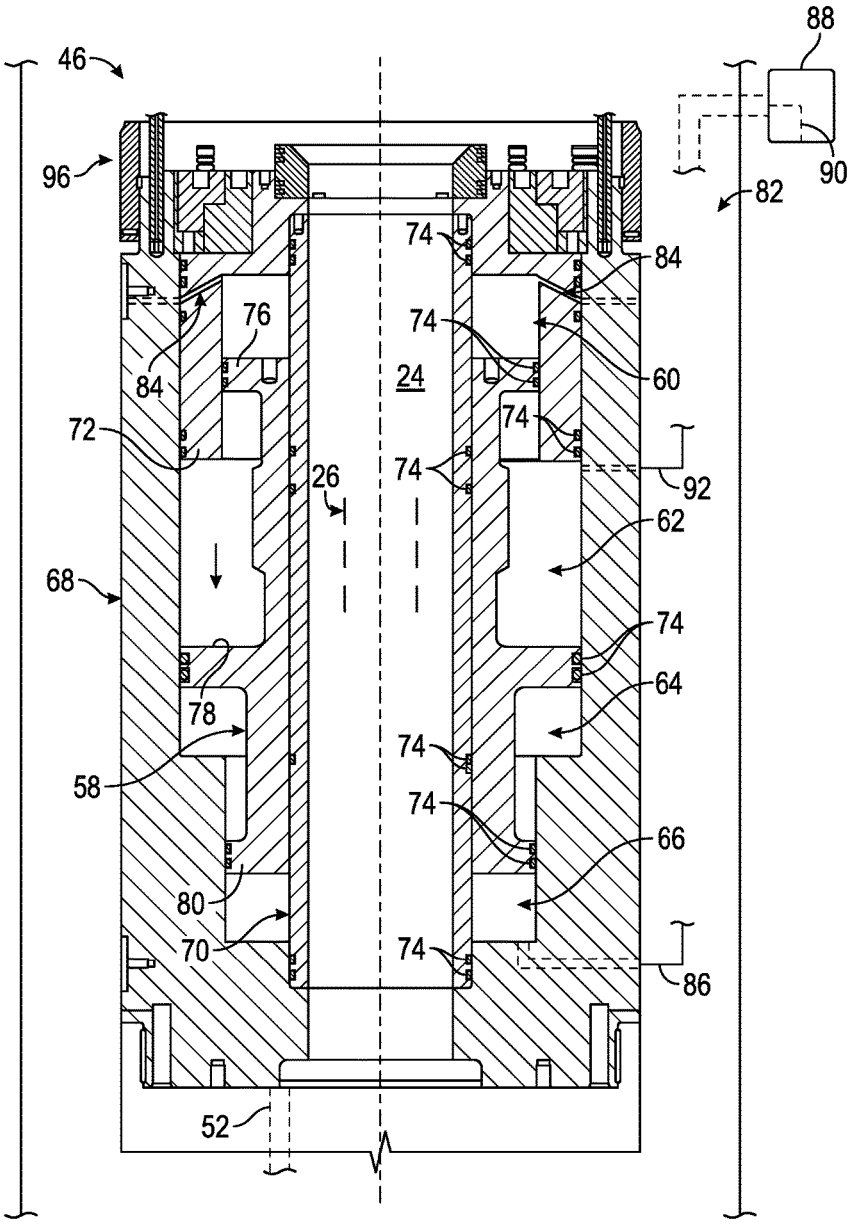
FIG. 3 is a cross-sectional view of an example of an actuation system for use with a failsafe valve, according to an embodiment of the disclosure.

With additional reference to FIG. 3, a specific embodiment of actuation system 46 is illustrated. In this embodiment, the actuator piston 58 is slidably mounted between an interior tubular member 70, defining a portion of interior passage 24, and the surrounding housing 68. In some applications, the tubular member 70 may be positioned within housing 68 via at least one suitable mounting structure 72 of housing 68. The slidably mounted actuator piston 58 also may be sealed with respect to both the interior tubular member 70 and the surrounding housing 68 (with or without mounting structure 72) via a plurality of seals 74, e.g. O-ring seals. Seals 74 also may be utilized between other components, such as between mounting structure 72 and other portions of housing 68.

In the example illustrated, actuator piston 58 comprises an expanded region 76 which seals against an interior of the mounting structure 72 via at least one seal 74 to separate pressure chamber 60 and gas precharge chamber 62. The actuator piston 58 also comprises a larger diameter expanded region 78 which similarly seals against an interior surface of housing 68 via at least one seal 74 to separate gas precharge chamber 62 and low-pressure chamber 64. It should be noted low-pressure chamber 64 is not pressurized in this embodiment. Depending on the embodiment, chamber 64 may be an atmospheric chamber or a low-pressure gas charged chamber. The actuator piston 58 further comprises an additional expanded region 80 which seals against an interior surface of housing 68 via at least one seal 74 to separate the chamber 64 from control fluid chamber 66. In this example, the diameter of expanded region 78 is larger than the diameter of expanded region 76 to facilitate the cumulative application of force due to pressures in pressure chamber 60 and gas precharge chamber 62. The diameter of expanded region 78 also may be larger than the diameter of the additional expanded region 80. It should be noted the actuation system 46 is illustrated as placed in a wellbore such that an annulus 82 is formed between the actuation system 46 and the surrounding wellbore wall.

The structure of actuator piston 58 and the various chambers 60, 62, 64, 66 enable the application of substantial closing and cutting force to failsafe valve 44 when the pressurized control fluid is bled from control fluid chamber 66. In the illustrated example, the pressure chamber 60 may be placed in fluid communication with subsea control system 52 via a suitable passageway or passageways 84. In some applications, passageways 84 comprise gun drilled holes formed in actuation system 46. Additionally, the control fluid chamber 66 may be coupled with a control line 86 which enables selective pressurization of control fluid chamber 66 to shift the actuator piston 58 and the cutter valve 44 to an open position. The open position allows movement of fluid and/or well equipment 26, e.g. coiled tubing 28, through the interior passage 24.

The control line 86 may be coupled with subsea control system 52 and/or with a pressure control system 88, e.g. a hydraulic pump system, which may be located at the surface or at another suitable position. The pressure control system 52 and/or 88 is operated to selectively provide hydraulic fluid under pressure to control fluid chamber 66. The pressurized hydraulic fluid is used to drive piston 58 against the bias of chambers 60, 62 so as to shift the actuator piston 58 and valve 44 to the open position.

In some applications, pressure control system 88 may be part of or coupled with pressure supply equipment deployed along interior passage 24. In this type of application, the pressure supply equipment may be conveyed down interior passage 24 and used to monitor and refill the control fluid chamber 66 and/or to control the valve 44 and cutter 48 directly. The control line 86 may be appropriately routed to an interior or exterior of the actuation system 46 or may be drilled or otherwise formed within components of actuation system 46.

It should be noted that pressure control system 88 may comprise an individual system or a plurality of cooperating systems used to selectively apply pressurized fluid to one or more regions of actuation system 46. For example, the pressure control system 88 also may comprise suitable equipment, e.g. a fluid pumping system 90, so as to enable controllable increasing of the pressure in annulus 82 while also providing other controlled sources of pressure. In some applications, increased pressure in annulus 82 may be used to pressurized chamber 66 and/or other chambers along piston 58. However, dedicated control lines also may be used to supply pressure from system 88 to desired chambers of actuation system 46.

In some embodiments, for example, the pressure systems 52 and/or 88 may be coupled to gas precharge chamber 62 via an additional control line 92. In the event pressurized gas is lost from gas precharge chamber 62 (or the pressure of gas in chamber 62 is insufficient to close valve 44) increased pressure can be provided to chamber 62 via the corresponding pressure system and control line 92. It should be noted that control line 92 may be routed through or along the actuation system 46 and subsea test tree 22 via a variety of techniques.

Figure 4:
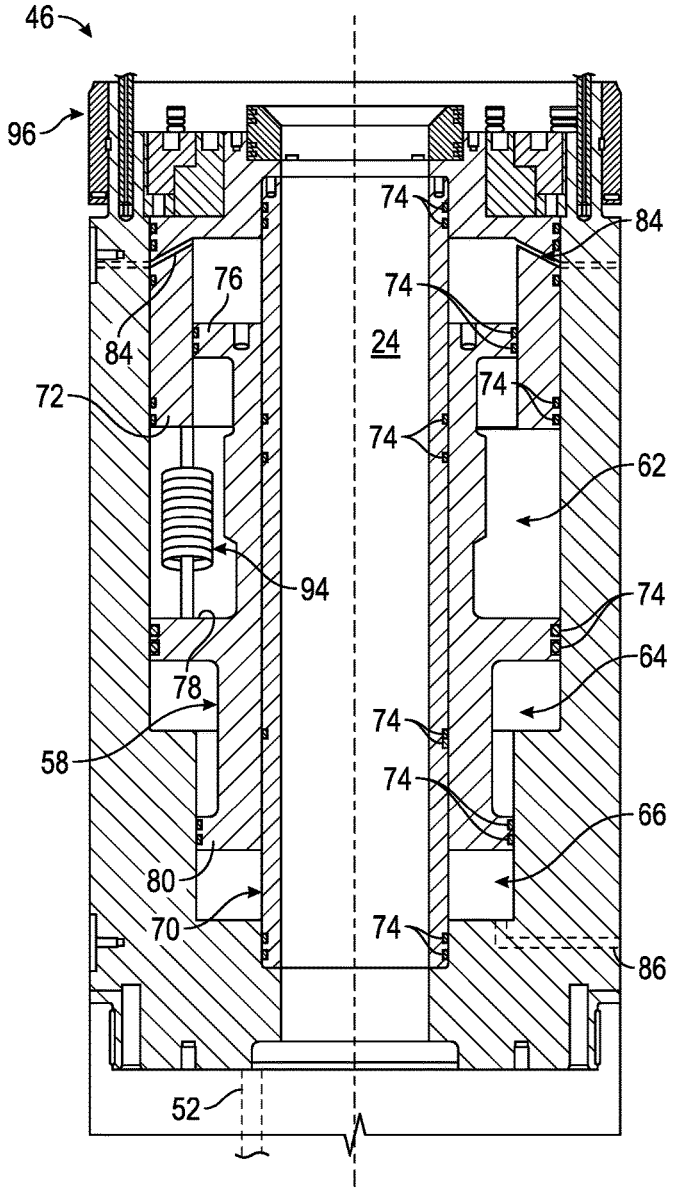
FIG. 4 is a cross-sectional view of another example of an actuation system for use with a failsafe valve, according to an embodiment of the disclosure.

The gas precharge chamber 62 may be pre-charged with various fluids. By way of example, the gas precharge chamber 62 may be pre-charged with nitrogen to a desired pressure. The desired pressure may vary depending on the application, available annulus pressure, arrangement of pressure system 88, depth of application, or other parameters. In some applications, an additional spring member 94, e.g. a coil spring, also may be added to facilitate movement of actuator piston 58 and valve 44 in a closing direction, as illustrated in FIG. 4. By way of example, the spring member 94 may be mounted within gas precharge chamber 62 in a position acting between housing 68, e.g mounting structure 72, and large diameter expanded region 78 to provide a closing bias even if gas in chamber 62 is lost. Depending on the configuration of subsea test tree 22, the actuation system 46 also may comprise a variety of connection related components 96 which are configured and oriented to facilitate coupling of the actuation system 46 with a next adjacent component of subsea test tree 22.

In operation, the subsea test tree 22 is deployed to a subsea location and positioned within the corresponding subsea equipment, e.g. blowout preventer. According to an embodiment, the pressure chamber 60 and subsea control system 52 are in fluid communication via control line 84. The subsea control system 52 is used to pressurize the control line 84 and the pressure chamber 60 to at least annulus pressure via a suitable technique. For example, the subsea control system 52 may comprise a pressure compensated chamber and/or a stored pressure volume to provide the desired pressure to chamber 60 via control line 84. The pressure in annulus chamber 60 and the pressure in gas precharge chamber 62 cumulatively act against actuator piston 58 and provide cumulative forces biasing actuator piston 58 and failsafe valve 44 to a closed position with respect to interior passage 24.

However, the valve 44 may be opened via pressure selectively applied to control fluid chamber 66. The control fluid chamber 66 may be monitored and refilled via various techniques. For example, the control fluid chamber 66 may be monitored and refilled via control line 86 routed to pressure control system 88 at a surface location or via control line 86 routed to the subsea control system 52. In some applications, pressure may be supplied to control fluid chamber 66 via annulus 82.

In some embodiments, additional shearing capability may be provided by using pressure control system 88 to increase the pressure in control line 84 and thus in pressure chamber 60. In general, however, the control line 84 is routed to subsea control system 52 which maintains the pressure chamber 60 at an annulus pressure or at a pressure higher than annulus pressure. Pressure boosting is further accomplished by having the pressure of gas precharge chamber 62, e.g. a nitrogen chamber, acting cumulatively with pressure chamber 60 while atmospheric chamber 64 provides little or no resistance. Additionally, some embodiments may utilize the control line 92 or control lines coupled to the gas precharge chamber 62 and/or the pressure chamber 60. The control line(s) 92 may be coupled with pressure control system 88 to enable a selective increase in pressure in the gas precharge chamber 62 and/or pressure chamber 60 to further enhance the shearing capability of cutter valve 44. Supplemental biasing components, such as spring member 94, may be used to provide increased valve closing bias in the event gas, e.g. nitrogen, is lost from gas precharge chamber 62.

The size and structure of the subsea test tree 22, failsafe valve 44, and actuation system 46 may be adjusted according to the parameters of a given application. For example, valve 44 may comprise a variety of ball valves, gate valves, or other valves which may be coupled to the actuation system 46 in a manner which ensures failsafe operation to prevent unwanted fluid flow through interior passage 24 in the event hydraulic control over the subsea test tree 22 is lost. The actuation system 46 as well as the linkage 50 between the actuation system 46 and valve 44 also may be adjusted to accommodate the specifics of a given application. For example, the size and configuration of the actuator piston and the corresponding chambers may be adjusted to provide the desired relative pressures and biasing forces acting on actuator piston 58 and valve 44. The subsea test tree 22 also may be used with various types of subsea equipment in many types of operations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in conjunction with a well, comprising:

a subsea test tree having an interior passage through which equipment may be passed, the subsea test tree comprising:

an upper valve system having at least one valve controlled hydraulically via hydraulic control lines;

a latch connector coupled to the upper valve section, the upper valve section being located above the latch connector; and a lower valve section located below the latch connector, the lower valve section having at least one cutter valve coupled with an actuation system, the actuation system comprising an actuator piston coupled to the cutter valve, the actuator piston being in fluid communication with a pressure chamber pressurized with at least an annulus pressure, a gas precharge chamber, a control fluid chamber, and a low-pressure chamber, the control fluid chamber being pressurized to move the actuator piston and the cutter valve to an open position, the pressure chamber and the gas precharge chamber cooperating such that pressures in the pressure chamber and the gas precharge chamber are cumulative and act together to apply a greater force than the force that would result from pressure in the pressure chamber or the gas precharge chamber alone, the greater force helping the cutter valve to cut through the equipment and close the interior passage when sufficient pressure is bled from the control fluid chamber.

2. The system as recited in claim 1, wherein the cutter valve comprises a ball valve having a cutter edge.

3. The system as recited in claim 1, wherein the control fluid chamber is coupled with a control line which may be selectively pressurized to shift the cutter valve to an open position.

4. The system as recited in claim 1, further comprising equipment deployed along the interior passage in the form of coiled tubing.

5. The system as recited in claim 1, further comprising a pressure control system operable to control pressure in the pressure chamber to an annulus pressure level or higher to provide the cutter valve with greater cutting force.

6. The system as recited in claim 1, wherein the gas precharge chamber is precharged with nitrogen.

7. The system as recited in claim 1, further comprising a mechanical spring located in the gas precharge chamber.

8. The system as recited in claim 1, wherein the actuator piston is mechanically linked to the cutter valve.

9. The system as recited in claim 1, further comprising a subsea control system coupled with the pressure chamber to enable controlled application of pressure to the pressure chamber.

10. A system, comprising:

a valve combined with a cutter; and an actuation system operatively coupled with the valve, the actuation system comprising an actuator piston coupled with the valve to transition the valve and the cutter between an open position and a closed position, the actuator piston being slidably mounted within a housing and having a plurality of radially expanded regions arranged to form a pressure chamber, a gas precharge chamber, and a control fluid chamber, the control fluid chamber being pressurized to move the actuator piston to an open position while the pressure chamber and the gas precharge chamber cooperate such that pressures in the pressure chamber and the gas precharge chamber are cumulative and act together to apply a greater force than the force that would result from pressure in the pressure chamber or the gas precharge chamber alone so as to bias the valve and the cutter toward a closed position.

11. The system as recited in claim 10, wherein the valve and the actuation system are part of a subsea test tree.

12. The system as recited in claim 11, wherein an interior passage extends through the subsea test tree, including through the actuator piston and the valve.

13. The system as recited in claim 12, wherein coiled tubing is deployed along the interior passage through the actuator piston and the valve.

14. The system as recited in claim 12, wherein the valve comprises a ball valve.

15. The system as recited in claim 12, further comprising a pressure control system controllable to selectively increase pressure acting on the actuator piston to thus increase cutting power of the cutter as the valve is transitioned to a closed position blocking flow along the interior passage.

16. A method, comprising:

providing a valve with a cutter oriented to sever equipment passing through an interior of the valve;

operatively coupling an actuator piston with the valve to enable failsafe actuation of the valve, the actuator piston being slidably mounted within a housing and having a plurality of radially expanded regions arranged to form a pressure chamber, a gas precharge chamber, and a control fluid chamber;

shifting the valve and the cutter to an open position by applying pressure in the control fluid chamber to shift the actuator piston; and biasing the actuator piston toward a closed position via pressure in the pressure chamber and the gas precharge chamber which cooperate so that pressures in the pressure chamber and the gas precharge chamber are cumulative and act together to apply a greater force than the force that would result from pressure in the pressure chamber or the gas precharge chamber alone to thus apply a cumulative closing force to the actuator piston.

17. The method as recited in claim 16, further comprising actuating the actuator piston to move the valve to a closed position by decreasing pressure in the control fluid chamber.

18. The method as recited in claim 16, further comprising actuating the actuator piston to move the valve to a closed position by decreasing pressure in the control fluid chamber and increasing pressure in the pressure chamber above an annulus pressure.

19. The method as recited in claim 16, wherein providing comprises providing the valve in the form of a ball valve with the cutter formed by a cutter edge positioned along the ball valve.

* * * * *